United States Patent [19]

Kiyoshi et al.

[11] Patent Number: 4,716,333

[45] Date of Patent: Dec. 29, 1987

[54] SHADOW MASK FOR A COLOR CATHODE RAY TUBE

[75] Inventors: Tokita Kiyoshi; Kondou Masayoshi, both of Saitama, Japan

[73] Assignee: Kabushiki Kaisha Toshiba, Japan

[21] Appl. No.: 640,390

[22] Filed: Aug. 13, 1984

[30] Foreign Application Priority Data

Aug. 16, 1983 [JP] Japan ..... 58-148843

[51] Int. Cl.[4] ..... H01J 29/80

[52] U.S. Cl. ..... 313/402; 313/473; 445/47; 445/58

[58] Field of Search ..... 313/402, 403, 408, 458, 313/473, 451; 445/58, 47; 422/64, 126, 126.2

[56] References Cited

U.S. PATENT DOCUMENTS

| | | | |
|---|---|---|---|
| 3,668,002 | 6/1972 | Okabe et al. | 427/126.2 |
| 3,802,757 | 4/1974 | Benda et al. | 313/481 |
| 3,887,828 | 3/1975 | Bathelt et al. | 313/402 |
| 4,002,941 | 1/1977 | Demmy | 313/402 |
| 4,317,749 | 3/1982 | Provance et al. | 427/126.2 |
| 4,339,687 | 7/1982 | Redington | 313/402 |
| 4,442,376 | 4/1984 | Van Der Waal et al. | 313/402 |

FOREIGN PATENT DOCUMENTS

| | | | |
|---|---|---|---|
| 50-44771 | 4/1975 | Japan . | |
| 50-88974 | 7/1975 | Japan . | |
| 0155624 | 9/1983 | Japan | 427/64 |
| 8004076 | 2/1982 | Netherlands . | |
| 960257 | 6/1964 | United Kingdom . | |
| 2000367 | 1/1979 | United Kingdom . | |

*Primary Examiner*—David K. Moore

*Attorney, Agent, or Firm*—Banner, Birch, McKie & Beckett

[57] ABSTRACT

A color cathode ray tube contains a shadow mask having a layer consisting essentially of a ceramic material, such as lead borate glass, on at least one side of the major face of the mask. Thermal expansion of the shadow mask is limited by bonding the ceramic layer to the shadow mask at a temperature at least as high as the normal operating temperature of the shadow mask. When the mask cools to room temperature, it does not fully contract but retains a residual tensile stress because of the bonded ceramic layer.

21 Claims, 6 Drawing Figures

SHADOW MASK FOR A COLOR CATHODE RAY TUBE

BACKGROUND OF THE INVENTION

FIG. 1 illustrates the general construction of color cathode ray tubes to which this invention relates. The tube's glass envelope comprises a substantially rectangular panel 1 connected to a neck 3 by a funnel 2. On the inner surface of the panel 1 is a phosphor screen with a plurality of vertically-aligned phosphor stripes which emit red, green, or blue light when struck by electron beams. The source of the electron beams is an in-line electron gun 6 in the neck, emitting three electron beams 10 in a generally horizontal direction, the three beams corresponding to the three colors of phoshor stripes. Between the electron guns and the phosphor screen, and closely adjacent to the phosphor screen, is shadow mask 5 having a number of apertures 52 in its major face 51. Shadow mask 5 also has a skirt portion 8 extending rearward from the periphery of major face 51. Skirt 8 is held in place by a mask frame 7 of L-shaped cross section. Frame 7, in turn, is attached through springs 9 to pins (not shown) buried in the inner side walls of panel 1.

As the electron beams travel from the electron guns to the phosphor screen, they are deflected by a deflection yoke (not shown) surrounding the outside of funnel 2 so as to scan the entire area of screen 4 in the familiar raster pattern. The function of the shadow mask is to permit each electron beam to strike the correct color phosphor stripes while at the same time preventing it from striking any other color phosphor stripe. The electron beams therefore pass through the mask's apertures but are absorbed where they strike the mask at a point in which no aperture is formed.

Only about one-third of the total electron beam energy leaving the electron guns reaches the phosphor screen. The rest is intercepted by the shadow mask and converted into heat, so that the normal operating temperature of the shadow mask generally reaches 353 K. Since the shadow mask is generally made of a thin plate (0.1–0.3 mm) of cold rolled steel which essentially consists of iron, it has a large thermal expansion coefficient, as much as about $1.2\times10^{-5}$/K (at a temperature of 273 K.–373 K.). The mask frame, which supports the skirt portion of the shadow mask, is much heavier, being made of cold rolled steel of about 1.0 mm thickness. The mask frame also is generally coated with a black oxide layer. Consequently, when the shadow mask is bombarded with electron beams, heat will readily be conducted or radiated from the skirt portion of the mask to the mask frame, and the temperature of the periphery of the major face of the shadow mask will be considerably lower than the temperature of the center of the major face. This temperature differential causes a distortion in the mask called "doming." Doming is a localized distortion, caused by differential heating, in which a portion (commonly the central portion) of the shadow mask's major face expands more than another portion (commonly the periphery) of the major face, causing the warmer portion to swell in the direction of the screen. As a result, the distance between the shadow mask and the phosphor screen is reduced below the proper distance necessary to maintain the critical alignment between each electron beam, the apertures, and the corresponding phosphor stripes. Color purity is therefore deteriorated. Doming is particularly noticeable when the device (television receiver or monitor) containing the color cathode ray tube is first turned on. It is also particularly noticeable when one portion of the image being produced by the color cathode ray tube is much brighter than the rest of the image.

Various schemes have been proposed to solve the heating problem. For example, U.S. Pat. No. 2,826,583 issued on Mar. 11, 1958, showed a black carbon layer deposited on the surface of the shadow mask to improve radiation. However, because of the constant expansion and contraction of the shadow mask, pieces of these black carbon layers break off inside the envelope and create problems by lodging in apertures of the shadow mask or in various locations within the electron gun.

In U.S. Pat. No. 3,887,828, issued on June 3, 1975 (and the corresponding Japanese Patent No. Disclosure 50-44771, disclosed on Apr. 22, 1975), it is proposed that the electron gun side of the shadow mask be covered in succession by three layers of material: a porous manganese dioxide layer, an aluminum layer, and a nickel oxide or nickel-iron oxide evaporated layer. In this type of shadow mask, heat generated by electron beam bombardment spreads throughout the surface of the triple layer but is not conducted to the shadow mask because the thermal conductivity of porous manganese dioxide is extremely low. This triple-layered shadow mask effectively prevents the high temperatures which cause shadow mask doming; but the article is ill suited for mass production because of the large scale of equipment and long production time necessary to produce such a mask.

SUMMARY OF THE INVENTION

It is an object of the present invention to provide a color cathode ray tube having a shadow mask in which doming is reduced or eliminated.

Another object of the invention is to provide a color cathode ray tube having such a shadow mask which is suitable for mass production.

A further object of the invention is to provide a color cathode ray tube with good color purity.

The present invention accomplishes the foregoing and other objects by bonding to a major face of the shadow mask a layer consisting essentially of a ceramic material. The ceramic layer is attached to the surface of the shadow mask by high temperature heat treatment so that, when the shadow mask with the ceramic layer cools, the metal of the mask retains a residual tensile stress tending to expand the mask. Therefore, when the ceramic-layered mask is heated to ordinary operating temperatures, there is hardly any expansion, only reduction in the residual tensile stress.

DETAILED DESCRIPTION OF THE PREFERRED EMBODIMENT

Figure 4:
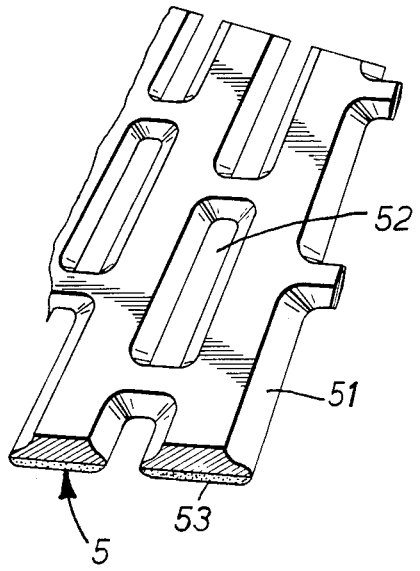
FIG. 4 is a perspective view of a portion of a shadow mask produced in accordance with the invention.

As shown with FIG. 4, shadow mask 5 has a layer 53 covering the entire surface of the electron gun side of the major face 51 mask 5 except in the area of aperatures 52. Layer 53, which consists essentially of a ceramic material such as crystalline lead borate glass (for example, sold by Asahi Glass Company, Ltd. as ASF-1307) is chemically bonded or sealed to the shadow mask by high temperature heat treatment.

In order to form the ceramic layer on the shadow mask, a solution of lead borate glass mixed with a vehicle such as acetic butyl alcohol containing several percent by weight of nitrocellulose is sprayed on the electron gun side of the major face of the shadow mask. This is accomplished before the panel of the cathode ray tube's envelope is sealed to the funnel. Next, the panel (with the shadow mask attached) and the funnel, supported next to the panel, are passed through a furnace which maintains them at a minimum temperature of 713 K. for at least 35 minutes. During this heat treatment, the layer of crystalline lead borate glass fuses and is bonded to the shadow mask, and the panel and the funnel sections of the envelope are sealed to each other.

Crystalline lead borate glass may crystallize when the amount of lead monoxide (PbO) contained in the glass is within the range of 44%–93% by weight. The crystallization is especially stable within the range of 70%–85% by weight of lead monoxide; and this range is suitable for mass production of shadow masks in accordance with this invention. Non-crystalline or amorphous glass, which melts at a temperature just above its softening temperature, is not suitable as the ceramic layer on a shadow mask, especially for a layer on the electron gun face of the mask, because that side of the mask reaches higher temperatures (up to about 573 K.) than the screen side of the mask. Therefore, crystalline glass such as lead borate glass, whose re-softening temperature is from 623 K. to 873 K., is preferable for the ceramic layer. Although there is a slight drawback to using crystalline glass—the manufacturing facility must have a furnace capable of heating the shadow mask to a bonding temperature between 673 and 873 K. for sufficient time (usually about 30 minutes) to fuse the glass and bond it to the mask—this drawback is overcome by simultaneously fusing and bonding the ceramic layer to the shadow mask and sealing together the funnel and panel portions of the envelope. In such an arrangement, it is preferable to include zinc oxide (ZnO) or cupric oxide (CuO) in the lead borate glass.

Figure 1:
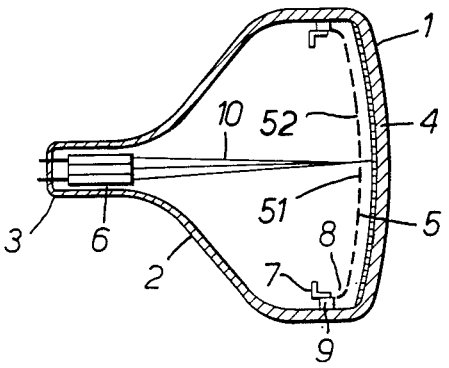
FIG. 1 is a sectional view of a color cathode ray tube to which this invention may be applied.
Figure 2A:
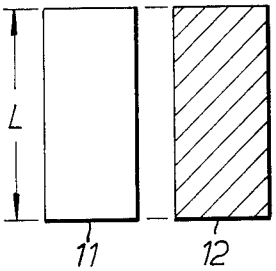
FIGS. 2A, 2B, and 2C are schematic diagrams illustrating the relationship between the ceramic layer and the metal shadow mask.
Figure 2B:
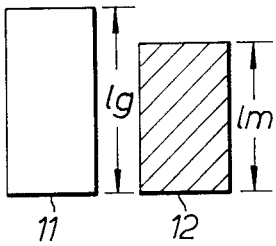
Figure 2C:
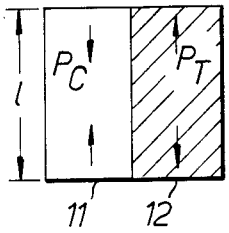

A shadow mask with a ceramic layer in accordance with this invention is capable of greatly reducing thermal expansion caused by initial heating of the shadow mask due to electron beam bombardment, because the shadow mask remains stretched or expanded due to the stress provided by the bonded ceramic layer. Thus, a cathode ray tube including such a shadow mask has good color purity and greatly reduced or elliminated doming. FIG. 2 illustrates schematically the reason for the improved performance of this shadow mask. FIG. 2A shows the relative lengths L of a portion of the ceramic layer 11 and a portion of the shadow mask 12, at the bonding temperature, for example 713 K. Separately, if both are cooled to room temperature, the length of the glass $l_g$ is greater than that of the shadow mask $l_m$ as shown in FIG. 2B because the coefficient of thermal expansion of the glass is less than that of the metal. For lead borate glass containing 70%–85% by weight of lead monoxide, the coefficient of thermal expansion is $0.7-1.2\times10^{-5}$/K., which is generally less than the $1.2\times10^{-5}$/K. coefficient for cold rolled steel, of which the shadow mask is composed. On the other hand, when the shadow mask is bonded to the ceramic layer at the bonding temperature and then both are cooled to room temperature, as shown in FIG. 2C, both pieces together contract to a length l which is shorter than the room temperature length $l_g$ of the glass alone but longer than the room temperature length $l_m$ of the shadow mask alone. This produces a residual tensile stress in the shadow mask and a residual compressive stress in the glass and prevents the shadow mask from fully contracting to its room temperature dimension. The residual compressive stress in the glass is schematically illustrated by the arrows $P_c$, and the residual tensile stress in the metal is schematically illustrated by the arrows $P_T$. Since the glass has a compressive strength about ten times its tensile strength, it is desirable that a slight compressive stress be maintained in the glass layer in order to balance the thermal expensive stress of the shadow mask. Lead borate glass containing 70%–85% by weight of lead monoxide is suitable from this point of view because the coefficient of thermal expansion of the glass is generally less than that of the steel shadow mask. (The invention is effective even for glass compositions whose coefficients of thermal expansion are close to, or equal to, that of the attached mask if the glass is bonded to the electron gun side of the mask, because the glass then reduces the heating of the mask due to electron bombardment. It is still preferable, however, to bond to the shadow mask a ceramic layer having a coefficient of thermal expansion *less than* that of the mask.) A desirable thickness of the ceramic layer is 20–30 um. Such a thickness will provide sufficient strength to withstand the tendency of the shadow mask to expand while at the same time not stressing the mask enough to deform it.

Figure 3:
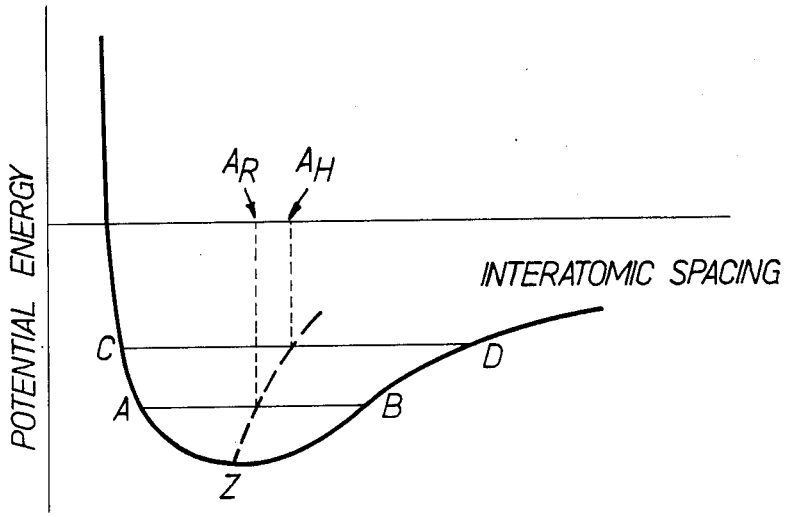
FIG. 3 is a graph of potential energy versus interatomic spacing within the metal of a shadow mask.

When a color cathode ray tube is constructed as outlined above, thermal expansion of the shadow mask caused by heating due to electron beam bombardment can be greatly reduced because the mask is maintained in an expanded condition. FIG. 3 is a graph of potential energy versus interatomic spacing within the metal of a shadow mask. Since vibrations of the atoms are not harmonic, the potential curve is asymmetric about the point of minimum potential—absolute zero point Z. Points A and B in FIG. 3 represent the limits of vibration of atoms at room temperature. At that temperature, the mean spacing between atoms is $A_R$. Points C and D represent the limits of vibration of atoms at a temperature above room temperature. At the temperature represented by C and D, the mean spacing between adjacent atoms is $A_H$. As can be seen in FIG. 3, the mean spacing between adjacent atoms increases with an increase in the amplitude of vibration because of the asymmetry of the potential curve. This phenomenon, the change in mean interatomic spacing with changes in temperature, is well known on the macroscopic scale as thermal expansion of solids.

The exact amount of expansion is given by the difference between $A_H$ and $A_R$. However, in a shadow mask manufactured in accordance with this invention, that is, a shadow mask with residual tensile stress maintained by a bonded ceramic layer, the amount of expansion due to heating is reduced. In a shadow mask according to the invention, the interatomic spacing at room temperature ($U_T$) is greater than the interatomic spacing at room temperature (u) of a conventional shadow mask because of the residual tensile stress. The amount of expansion due to heating is therefore $(A_H\text{-}A_R)(u/U_T)$. In other words, the amount of expansion due to heat is reduced by the ratio of the mean room temperature interatomic spacing of a shadow mask without the ceramic layer to that of a shadow mask with the ceramic layer.

The ceramic-layered shadow mask not only reduces expansion by mechanically limiting expansion of the steel shadow mask but also serves to insulate the mask from becoming heated initially, further reducing shadow mask expansion. If the ceramic layer is placed on the electron gun side of the shadow mask, since the thermal conductivity of lead borate glass is extremely small, heat caused by electron beam bombardment tends to radiate from the ceramic layer before being conducted to the shadow mask below.

A shadow mask manufactured in accordance with the present invention may be used, for example, in a twenty-one-inch-type color cathode ray tube. Such a tube ordinarily has a shadow mask made of cold rolled steel of 0.22 mm thickness. In order to prepare the ceramic layer, the material ASF-1307 (made by Asahi Glass Company, Ltd.), which includes lead borate glass with a thermal expansion coefficient of about $1.0\times10^{-5}$/K. at temperatures near the sealing temperature, is sprayed onto the electron gun side of the major face of a shadow mask and crystallized by the process described above. This produces a ceramic layer with a thickness of about 25 um. For comparison, the radius of curvature in the horizontal direction of the shadow mask is about 1 m; the distance between the centers of adjacent phosphor stripes is about 260 um, and the light absorbing stripes between phosphor stripes have a width of about 120 um.

A color cathode ray tube constructed as described above, having a shadow mask made in accordance with the invention, was operated for 5 minutes at 25 $kV_{DC}$ anode voltage and 1.5 $mA_{DC}$ anode current. At that time, the maximum displacement of the electron beam in the horizontal direction on the phosphor screen was measured in order to evaluate doming. The measurement was taken in the region 140 mm from the center of the screen, where doming is most severe. (Although the screen employs negative landing construction, meaning that the electron beam covers not only the full width of the phosphor stripe but also extends into both light absorbing stripes on either side of the phosphor stripe, the displacement of the electron beam may be measured by measuring the brightness of the phosphor.) When this measurement was made in a cathode ray tube constructed in accordance with this invention, the displacement of the electron beam was only 66 um, well below the 75 um considered to be the maximum permissible displacement for acceptable color purity of the green phosphor stripes, which are most affected in brightness. By contrast, a conventional color cathode ray tube, when measured using the same procedure, had an electron beam displacement of 85 um, which is outside the acceptable range for color purity.

Since the shadow mask would probably be vibrated when the cathode ray tube is operated, and since the shadow mask has a heavy glass layer on its major face, vibration of the shadow mask of the invention will be considered as follows. It may be assumed that the shadow mask would be vibrated, with the skirt portion fixed, by external vibrations such as the sound from the television speaker (especially low frequency sound). In general, the maximum displacement (J) of a beam which is simply supported at both ends is given by $$J = \frac{5WL^4}{384EI},$$

where L is length of the beam between both fixed ends, W is the weight of a unit length of beam, E is Young's modulus, and I is the second moment in cross section of the beam. Therefore, displacement J of the shadow mask will increase when the weight of the major face of the shadow mask increases. However, since the stiffness of the shadow mask may be increased by extending the ceramic layer to the skirt portion, excessive vibration of the shadow mask may be prevented.

The ceramic layer may also be bonded to the screen side of the shadow mask, in addition to (or instead of) the electron gun side. A black oxide layer covering the surface of the shadow mask improves bonding between the shadow mask and the ceramic layer (such as lead borate glass) because the oxide layer activates and strengthens chemical bonding between the shadow mask and the ceramic layer.

The ceramic layer may also be applied effectively to shadow masks made of materials, such as Invar (trademark for an alloy of iron with about 35.5 to 36 percent nickel), upon which a black oxide layer is difficult to form. The ceramic layer itself may be blackened if a black pigment, such as manganese dioxide ($MnO_2$) or cobalt (III) oxide ($Co_2O_3$), is added to the lead borate glass before coating the mask. So, when a shadow mask made of Invar is provided with a ceramic layer made of lead borate glass containing black pigment, the shadow mask has an improved emissivity. In addition, the black ceramic layer is much more securely attached than prior art carbon layers because its coupling to the shadow mask is a strong chemical bond.

Although illustrative embodiments of the present invention have been described in detail with reference to the accompanying drawings, it is to be understood that the invention is not limited to those precise embodiments and that various changes or modifications may be effected therein by one skilled in the art without departing from the scope or spirit of the invention.

We claim:

1. A color cathode ray tube comprising:

an envelope having a neck portion and a panel portion;

electron gun means within said neck portion for emitting an electron beam directed toward said panel portion;

a plurality of colored phosphor stripes on a surface of said panel portion to emit colored light when struck by the electron beam; and a shadow mask between said panel portion and said electron gun means to permit the electron beam to strike the correct color phosphor stripe while preventing the electron beam from striking another color phosphor stripe, said shadow mask comprising;

a. a major face containing a plurality of apertures, b. a skirt portion extending from the periphery of said major face; and c. a layer consisting essentially of a ceramic material bonded to said major face by heat treatment so that said shadow mask includes residual tensile stress.

2. A color cathode ray tube as claimed in claim 1 wherein said layer extends to at least part of said skirt portion.

3. A color cathode ray tube as claimed in claim 1 wherein a thermal expansion coefficient of said layer is smaller than the thermal expansion coefficient of said shadow mask at the same temperature.

4. A color cathode ray tube as claimed in claim 1 wherein said layer comprises crystalline glass.

5. A color cathode ray tube as claimed in claim 4 wherein said glass is lead borate glass.

6. A color cathode ray tube as claimed in claim 5 wherein said lead borate glass includes from 70% to 85% by weight of lead monoxide (PbO).

7. A color cathode ray tube as claimed in claim 1 wherein said layer includes black pigment.

8. A color cathode ray tube as claimed in claim 7 wherein said black pigment consists essentially of manganese dioxide ($MnO_2$).

9. A color cathode ray tube as claimed in claim 7 wherein said black pigment consists essentially of cobalt (III) oxide ($Co_2O_3$).

10. A color cathode ray tube as claimed in claim 1 further comprising an oxide layer between said major face and said ceramic layer.

11. A method of reducing the doming of a shadow mask including a major face containing a plurality of apertures in a colored cathode ray tube, said method comprising the steps of:

coating said major face of the shadow mask with a ceramic material; and raising the temperature of the coated shadow mask to a temperature at least as high as the normal operating temperature of the shadow mask and sufficiently high to fuse the ceramic material and bond it to the mask.

12. A shadow mask for a colored cathode ray tube, said shadow mask including a layer of fused ceramic material bonded to a major face containing a plurality of apertures, said layer of fused ceramic material having a thermal expansion coefficient smaller than the thermal expansion coefficient of said shadow mask at the same temperature.

13. A shadow mask according to claim 12 wherein said layer comprises crystalline glass.

14. A shadow mask according to claim 13 wherein said glass is lead borate glass.

15. A shadow mask according to claim 14 wherein said glass includes from 70% to 85% by weight of lead monoxide (PbO).

16. A shadow mask according to claim 12 wherein said layer includes black pigment.

17. A shadow mask according to claim 16 wherein said black pigment consists essentially of manganese dioxide ($MnO_2$).

18. A shadow mask according to claim 16 wherein said black pigment consists essentially of cobalt (III) oxide ($Co_2O_3$).

19. A shadow mask according to claim 12 further comprising an oxide layer between said major face and said ceramic layer.

20. A color cathode ray tube as claimed in claim 1 further comprising a screen electrically connected to said shadow mask and disposed on the inner portion of said panel portion, said phospher stripes being disposed on said screen.

21. A shadow mask as claimed in claim 20 wherein said shadow mask is electrically connected to a phospher screen within said cathode ray tube.

* * * * *